US007634210B2

(12) United States Patent
Soma et al.

(10) Patent No.: US 7,634,210 B2
(45) Date of Patent: Dec. 15, 2009

(54) CLEANING SYSTEM FOR AN IMAGE FORMING APPARATUS FOR MARGIN-LESS PRINTING AND CONTROL METHOD THEREOF

(75) Inventors: Utami Soma, Hachioji (JP); Atsushi Takahashi, Akishima (JP); Tadashi Matsudaira, Hachioji (JP); Youbao Peng, Hino (JP); Hiroshi Oyama, Hino (JP); Shinpei Kawasaki, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 224 days.

(21) Appl. No.: 11/810,994

(22) Filed: Jun. 7, 2007

(65) Prior Publication Data

US 2008/0124112 A1 May 29, 2008

(30) Foreign Application Priority Data

Nov. 28, 2006 (JP) ..... 2006-320019

(51) Int. Cl.
*G03G 15/00* (2006.01)

(52) U.S. Cl. ..... 399/71; 399/343; 399/45; 399/389; 399/327

(58) Field of Classification Search ..... 399/45, 399/71, 327, 343, 389
See application file for complete search history.

(56) References Cited

U.S. PATENT DOCUMENTS

2007/0008397 A1* 1/2007 Maebashi ..... 347/158

FOREIGN PATENT DOCUMENTS

| | | | |
|---|---|---|---|
| JP | 2001-117382 A | | 4/2001 |
| JP | 2005-062412 A | | 3/2005 |
| JP | 2005062412 A | * | 3/2005 |

OTHER PUBLICATIONS

Japanese Office Action dated Nov. 5, 2008 and English translation thereof issued in a counterpart Japanese Application No. 2006-320019.

* cited by examiner

*Primary Examiner*—David M Gray
*Assistant Examiner*—G. M. Hyder
(74) *Attorney, Agent, or Firm*—Frishauf, Holtz, Goodman & Chick, P.C.

(57) ABSTRACT

An image forming apparatus comprising: an image forming section to form a toner image based on print data; a transfer section to transfer the toner image onto a transfer sheet; a fixing section to fix the toner image transferred onto the transfer sheet; a cleaning section for cleaning at least one of the image forming section, the transfer section and the fixing section; and a control section to determine an existence area of a real image in a print image based on the print data, to determine a size of the transfer sheet, onto which the print image is printed and to control the cleaning device based on determinations of the image determination section and the transfer sheet size determination section.

6 Claims, 11 Drawing Sheets

FIG. 4 ( a ) NORMAL MODE OPERATION
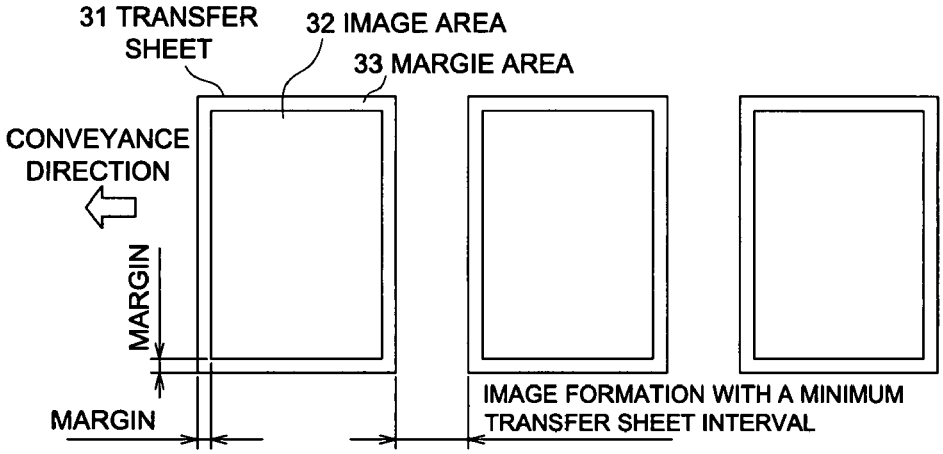
FIG. 4 ( b ) FULL SURFACE IMAGE MODE OPERATION
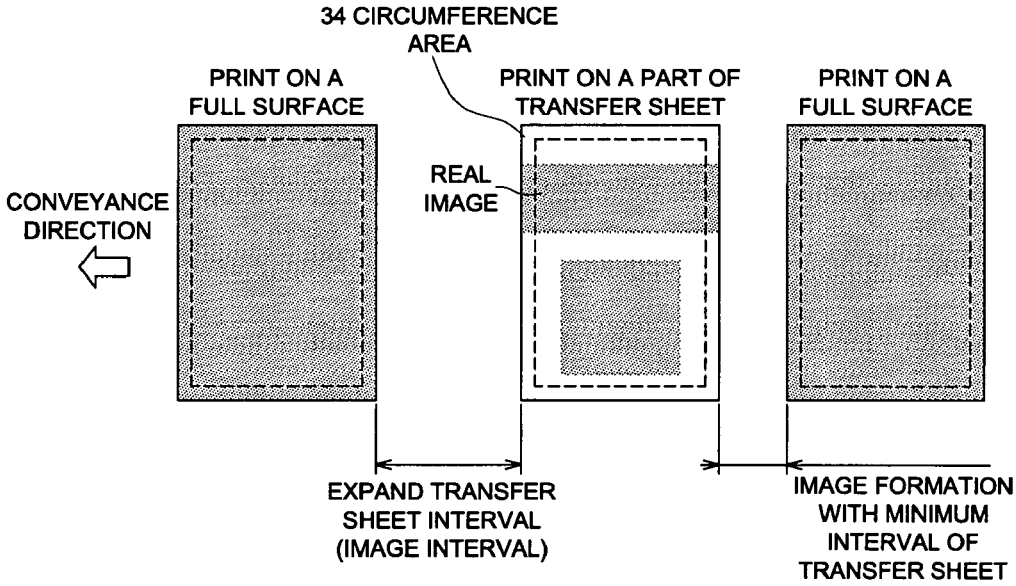

$$\text{PRINT RATIO} = \frac{\text{SUM OF PRINT PORTION AREA}}{\text{CIRCUMFERENCE AREA (SUM OF PRINT PORTION AREA + SUM OF MARGIN PORTION AREA)}}$$

$$\text{PRINT RATIO} = \frac{(\text{DARK PRINT PORTION AREA} \times \text{COEFFICIENT 1} + \text{LIGHT PRINT PORTION AREA} \times \text{COEFFICIENT 2})}{\text{SPACE OF CIRCUMFERENCE AREA}}$$

FIG. 12 ( a ) NORMAL MODE OPERATION
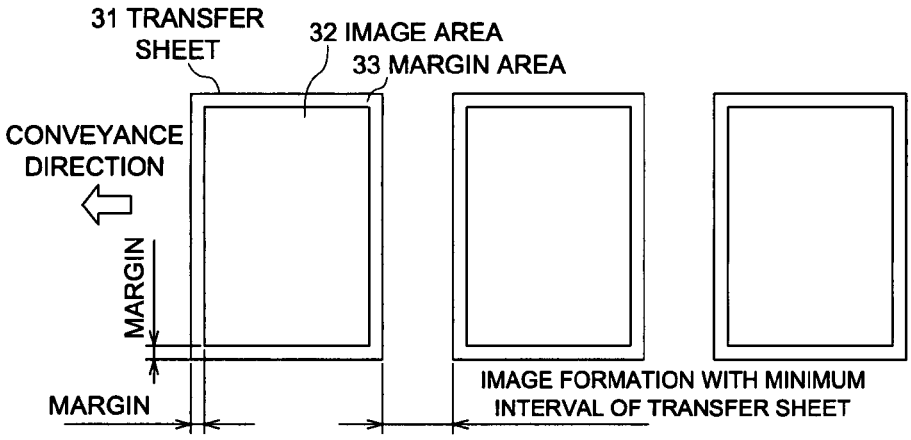
FIG. 12 ( b ) FULL SURFACE IMAGE MODE OPERATION
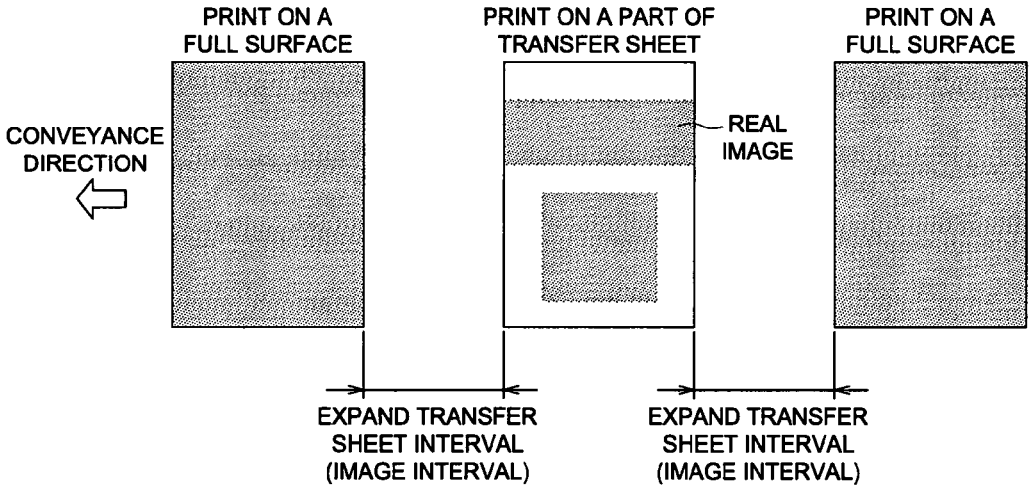

CLEANING SYSTEM FOR AN IMAGE FORMING APPARATUS FOR MARGIN-LESS PRINTING AND CONTROL METHOD THEREOF

This application is based on Japanese Patent Application No. 2006-320019 filed on Nov. 28, 2006, in Japanese Patent Office, the entire content of which is hereby incorporated by reference.

TECHNICAL FIELD

The present invention relates to an image forming apparatus, a control method and a control program thereof, and particularly relates to an image forming apparatus having a mode for forming an image onto the full surface of a transfer sheet and the control method and the control program of a cleaning device in the mode.

BACKGROUND

The image forming apparatus for forming an image onto the transfer sheet by using an electro photographic system or an inkjet system has become popular. In many cases, this image forming apparatus includes two kinds of mode. The first mode is a mode for printing an image onto an image area 32 of a transfer sheet 31 leaving a margin area 33 on a circumference thereof, (which will be called a normal mode) as illustrated in FIG. 12(*a*). The second mode is a mode for printing an image onto a full surface of the transfer sheet without leaving a margin area on a circumference thereof as illustrated in FIG. 12(*b*), (which will be called a full surface image mode).

Here, in the full surface image mode, there is a problem that in order to print an image even on the edge section of the transfer sheet, each section of the image forming apparatus gets dirt due to the toner image positioned outside the transfer sheet and the dirt gets into the edge portion and the rear surface of the transfer sheet. Thus, in order to remove this dirt, cleaning devices are provide in respective sections of the image forming apparatus and the cleaning devices conduct cleaning processes after completing the printing of the image onto the transfer sheet and before conducting the printing operation of the next transfer sheet.

With respect to the cleaning process in the full surface image mode as described above, for example, Japanese Patent Application Publication No. 2001-117382 discloses a method of executing a cleaning operation of a transfer roller, which is conducted in a post-rotation process, when finishing the image forming process conducted after completing the fixing operation, for a longer time than that in a normal print mode, in a full surface print mode of the image forming apparatus having two modes including a normal print mode where a print impossible area is provided on the circumference portion and a full surface area print mode where an image can be printed onto the full surface area of the transfer sheet without proving the print impossible area in the circumference portion of the transfer sheet. Even though the toner dirt occurs with a transfer roller, the dirt can be removed and a fine image is obtained on the full surface of the transfer sheet.

However, in order not to adhere the dirt onto the next transfer sheet, the cleaning process has to be completed before conducting the print operation of the next transfer sheet. As a result, as illustrated in FIG. 12(*b*), it is necessary to secure a long interval to the next transfer sheet. Thus, in the full surface image mode, there was a problem that the output productivity was extremely lowered.

A main object of the present invention is to provide an image forming apparatus and a control method, which are capable of suppressing the lowering of the output productivity in the mode where an image is printed on the full surface of a transfer sheet to solve the problems described above.

SUMMARY

One aspect of the present invention is an image forming apparatus comprising: an image forming section to form a toner image based on print data; a transfer section to transfer the toner image onto a transfer sheet; a fixing section to fix the toner image transferred onto the transfer sheet; a cleaning section to clean at least one of the image forming section, the transfer section and the fixing section; and a control section to determine an existence area of a real image in a print image based on the print data, to determine a size of the transfer sheet, onto which the print image is printed; and to control the cleaning device based on determinations of the existence area of a real image in a print image based on the print data and the size of the transfer sheet.

In this aspect, the control section may include an image determination section to determine an existence area of a real image in a print image based on the print data; a transfer sheet size determination section to determine a size of the transfer sheet, onto which the print image is printed; and a cleaning control section to control the cleaning device based on determinations of the image determination section and the transfer sheet size determination section.

Another aspect of the present invention is an image forming apparatus capable of selecting, at least, a mode, in which an image is printed onto a full surface of a transfer sheet, the image forming apparatus comprising: an image forming section to form a toner image based on print data; a transfer section to transfer the toner image onto a transfer sheet; a fixing section to fix the toner image transferred onto the transfer sheet; a cleaning section to clean one of the image forming section, the transfer section and the fixing section; and a control section to determine an existence area of a real image in a print image based on the print data, to determine a size of the transfer sheet, onto which the print image is printed, and to determine whether the cleaning device is activated according to a ratio of the real image existing in a circumference area of the transfer sheet for the respective transfer sheets when printing a plurality of transfer sheets in the mode.

In this aspect, the control section may comprises an image determination section to determine an existence area of a real image in a print image based on the print data; a transfer sheet size determination section to determine a size of the transfer sheet, onto which the print image is printed; and a cleaning control section to determine whether the cleaning device is activated according to a ratio of the real image existing in a circumference area of the transfer sheet for the respective transfer sheets when printing a plurality of transfer sheets in the mode.

Another aspect of the present invention is a control method for controlling an image forming apparatus, the image forming apparatus comprises: an image forming section to form a toner image based on print data; a transfer section to transferring the toner image onto a transfer sheet; a fixing section to fix the toner image transferred onto the transfer sheet; and a cleaning section to clean at least one of the image forming section, the transfer section and the fixing section, the method comprising: determining an existence area of a real image in a print image based on the print data; determining a size of the transfer sheet, onto which the print image is printed; and determining whether to activate the cleaning section or not based on the determined existence area of the real image and the determined size of the transfer sheet.

Another aspect of the present invention is a control method for controlling an image forming apparatus, the image forming apparatus comprises: an image forming section to form a toner image based on print data; a transfer section to transfer the toner image onto a transfer sheet; a fixing section to fix the toner image transferred onto the transfer sheet; and a cleaning section to clean at least one of the image forming section, the transfer section and the fixing section, the method comprising: when printing a plurality of transfer sheets in a mode in which an image is printed onto a full surface of the transfer sheet, determining an existence area of a real image in a print image based on the print data; determining a size of the transfer sheet, onto which the print image is printed; and determining whether to activate the cleaning device to each transfer sheet of the plurality of transfer sheets or not based on the determined existence area of the real image and the determined size of the transfer sheet.

BRIEF DESCRIPTION OF THE DRAWINGS

FIGS. 4(*a*)-4(*b*) illustrate the operations of a normal mode and a full surface image mode in an image forming apparatus of an embodiment of the present invention.

FIGS. 12(*a*)-12(*b*) illustrate illustrates the operations of a normal mode and a full surface image mode in a conventional image forming apparatus.

DESCRIPTIONS OF THE PREFERRED EMBODIMENT

In a relatively low cost and simple print system category, in many cases, simple bookbinding is conducted. In this case, print processes of a coversheet section and an inside section are continuously conducted. Here, in many cases, the image of a coversheet section is printed onto the full surface of the transfer sheet. With respect to the inside section, a page only for characters has many blank spaces, and a page including images, such as photographs, has many cases where the image extending to the edge section is formed. As described above, when the page, the image of which is formed onto the full surface of the transfer sheet and the page, the image of which is formed onto a part of a transfer sheet are mixed together, if a full surface image mode is set, even though there is a margin in the edge section, since the cleaning process is conducted after the image is formed on the page, the interval to the next transfer sheet is expanded, which results in a problem that the output productivity is lowered.

This problem is caused by that the full surface image mode is processed based on the assumption that an image is formed on the full surface wherever the image is actually formed in which part of the transfer sheet. Thus, in this invention, provided is the determination device for determining how much ratio of the circumference area of the transfer sheet is used for the image print. Then the determination device determines whether the cleaning process is conducted based on the determination result. As described above, even though the full surface image mode has been set, in the case of the page, where many images are formed in the circumference area of the transfer sheet, which will be used for the coversheet, the interval to the next page is expanded and the cleaning process is conducted. In the case of the other pages, the interval to the next page is shortened and the cleaning process will not be conducted. Based on this arrangement, the transfer sheet can be efficiently transferred. Further, the lowering of the output productivity can be suppressed.

EXAMPLE

Figure 1:
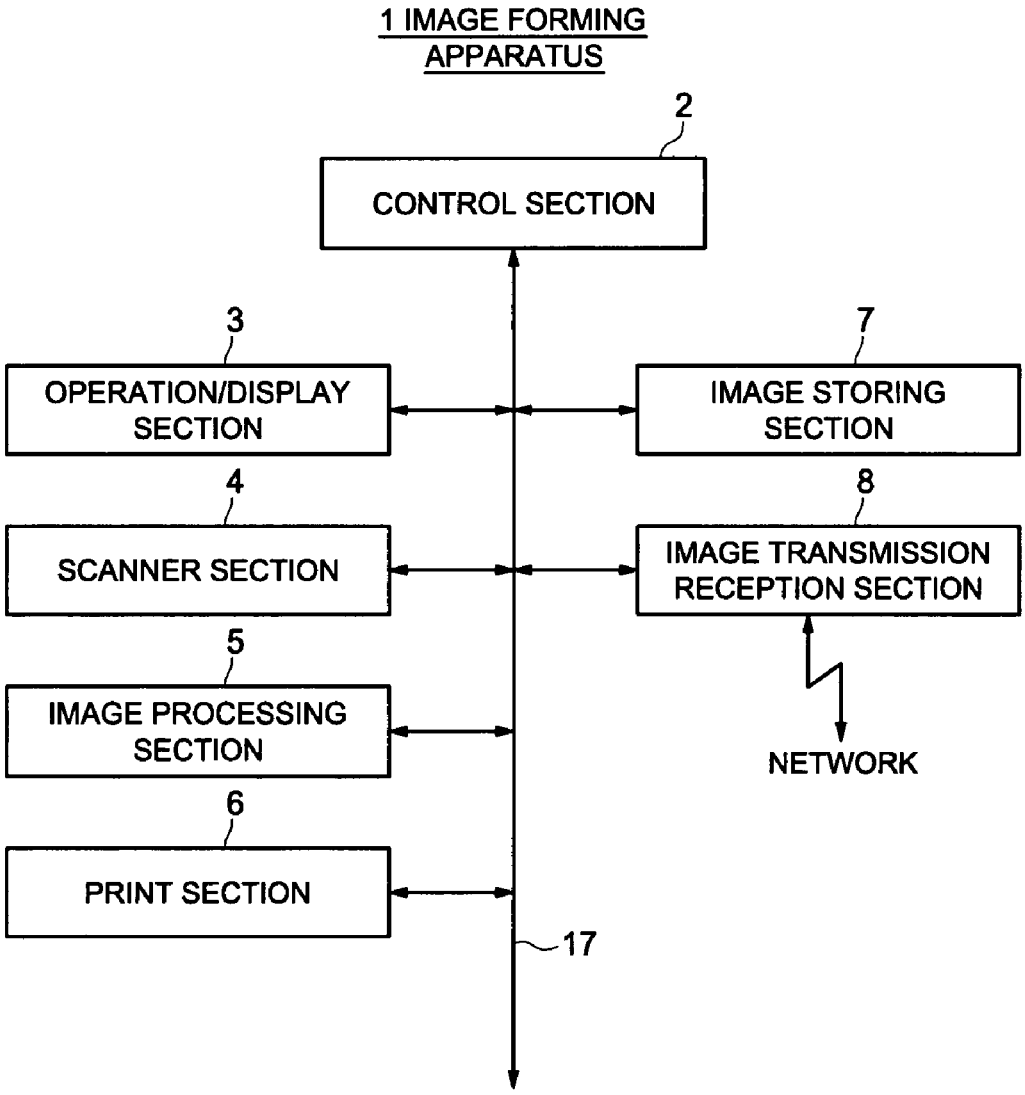
FIG. 1 illustrates a block diagram showing a configuration of the image forming apparatus of an embodiment of the present invention.
Figure 2:
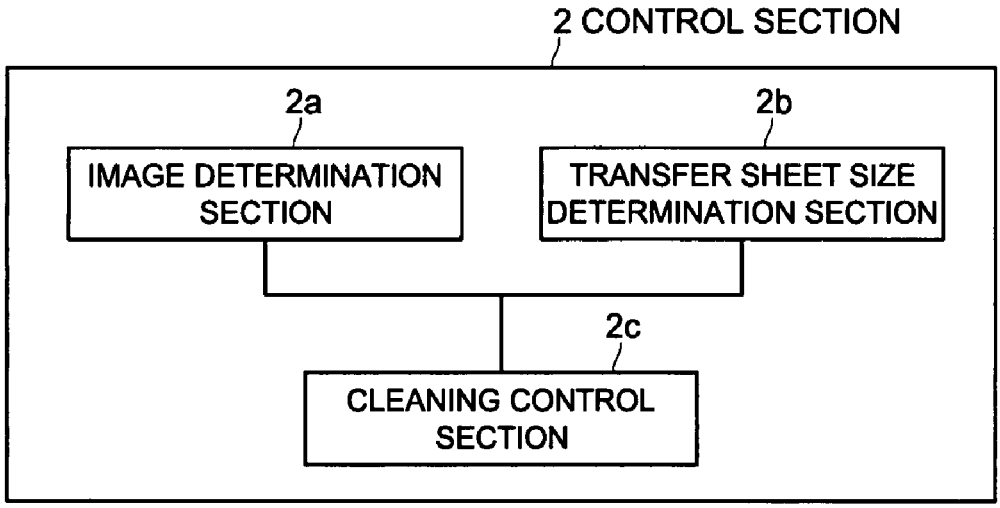
FIG. 2 illustrates a block diagram showing a configuration of the control section of the image forming apparatus of an embodiment of the present invention.
Figure 3:
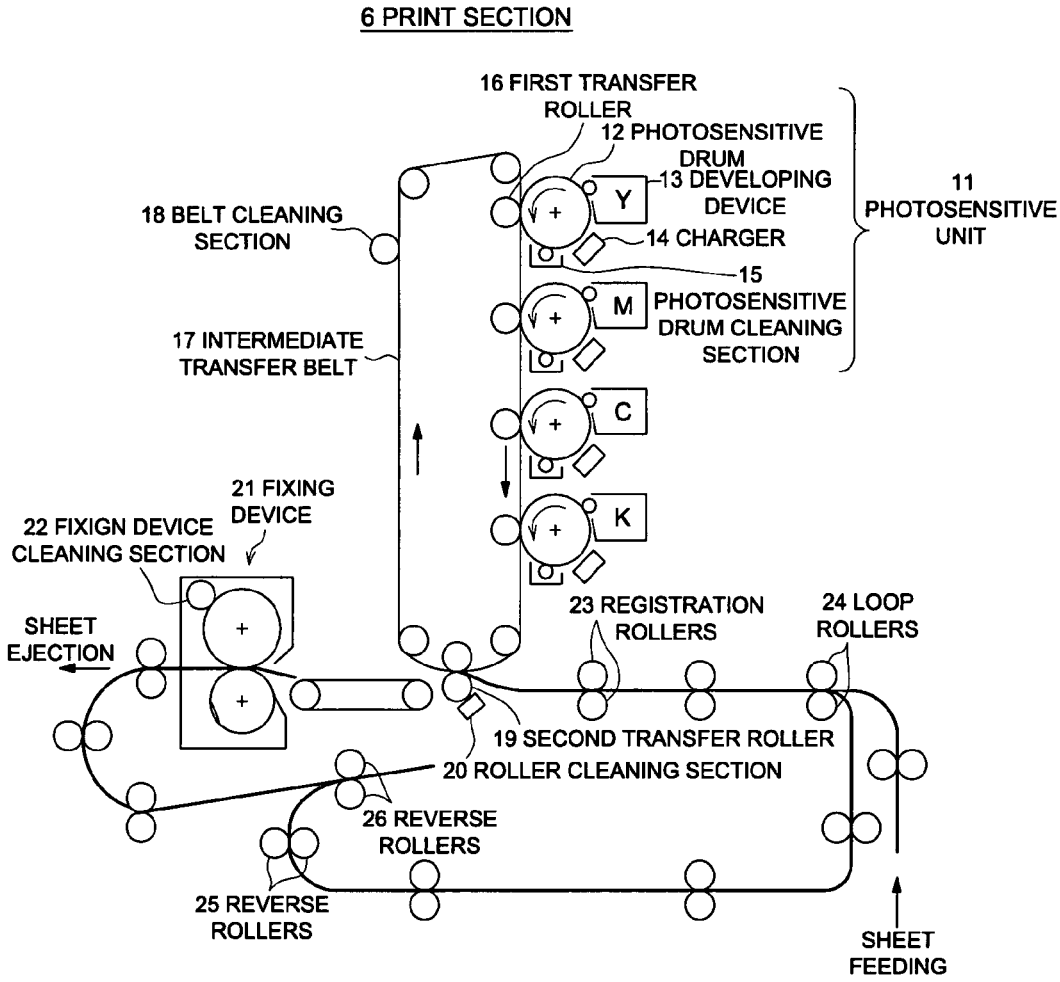
FIG. 3 schematically illustrates a detailed structure of the print section of the image forming apparatus of the present invention.
Figure 5:
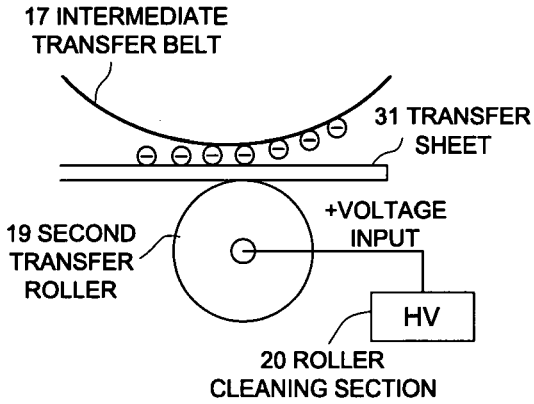
FIGS. 5(*a*)-5(*d*) illustrate the cleaning operation of the second transfer roller of an embodiment of the present invention.
Figure 5:
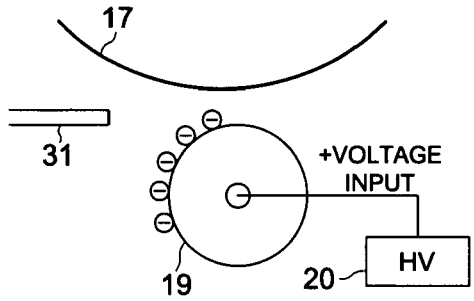
Figure 5:
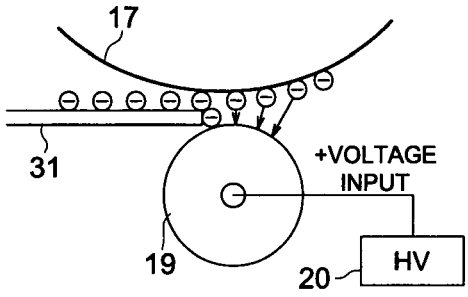
Figure 5:
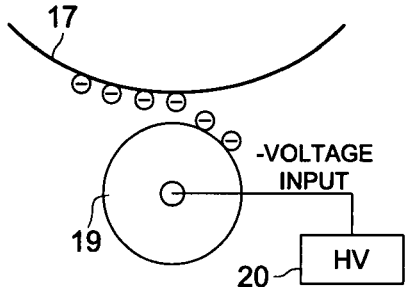
Figure 6:
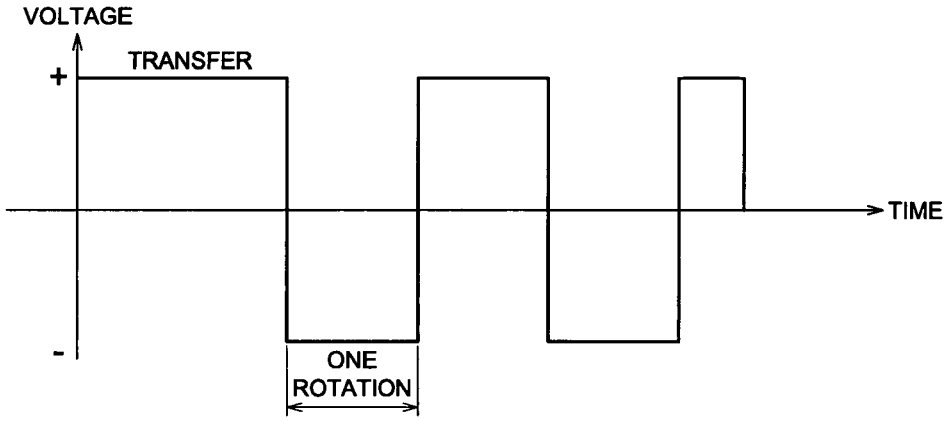
FIG. 6 illustrates a voltage pattern to be applied to the second transfer roller of an embodiment of the present invention.
Figure 7:
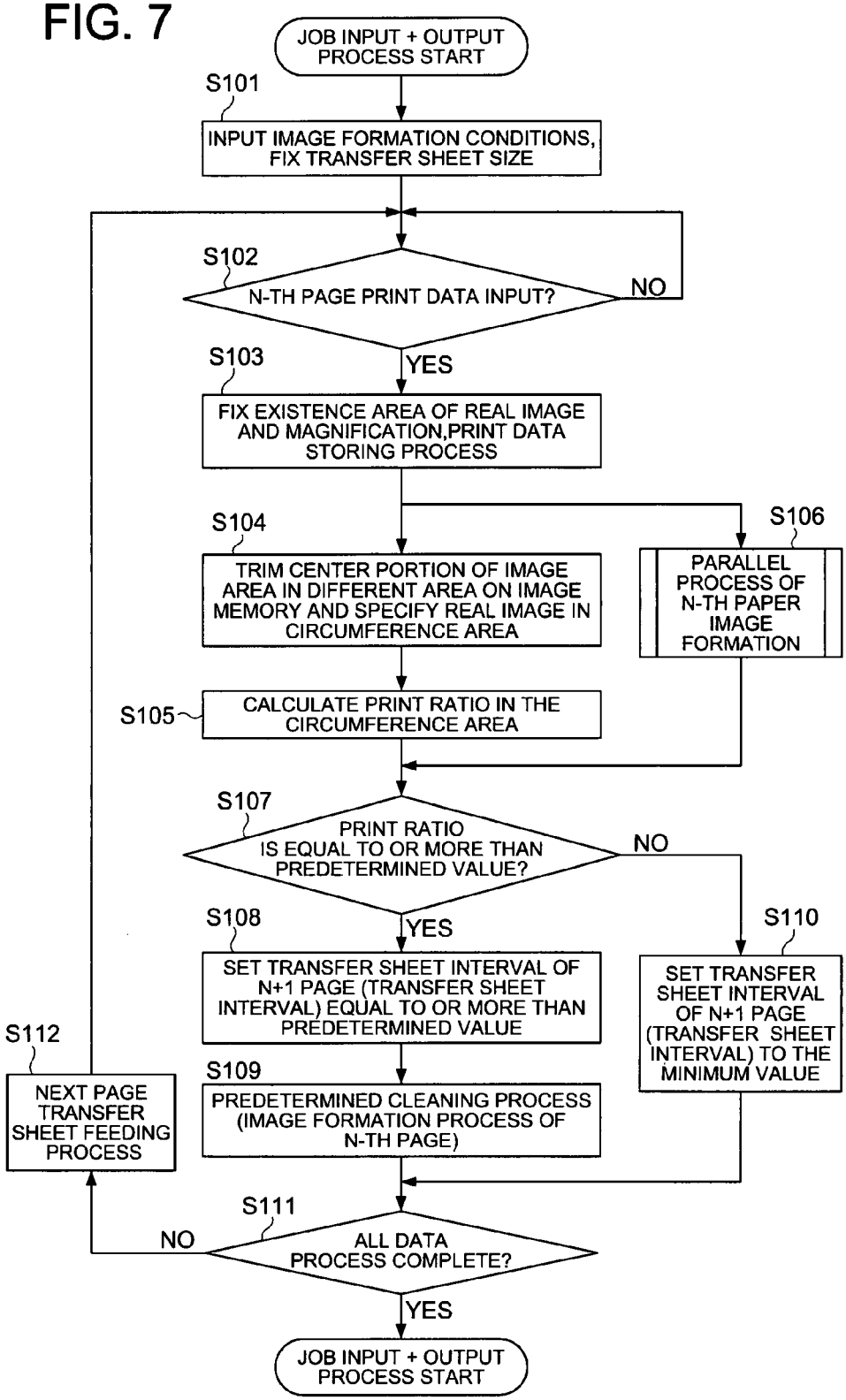
FIG. 7 illustrates a flowchart showing a print procedure used in the image forming apparatus of an embodiment of the present invention.
Figure 8:
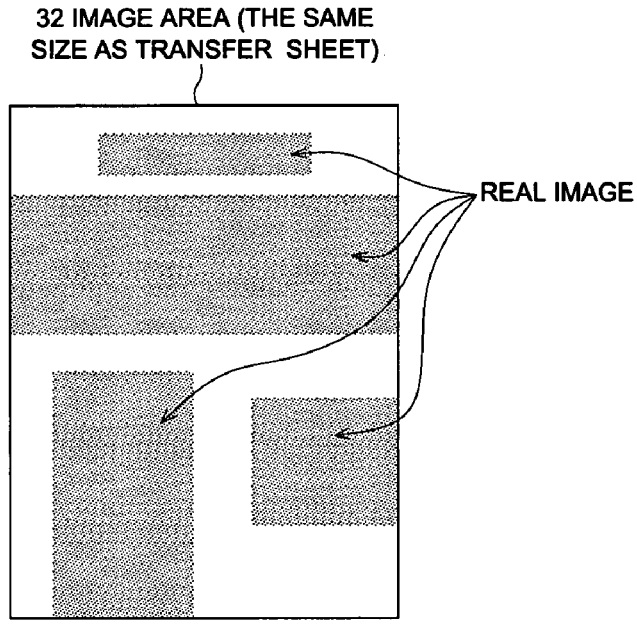
FIG. 8 illustrates a print ratio calculation method in the image forming apparatus of an embodiment of the present invention.
Figure 8:
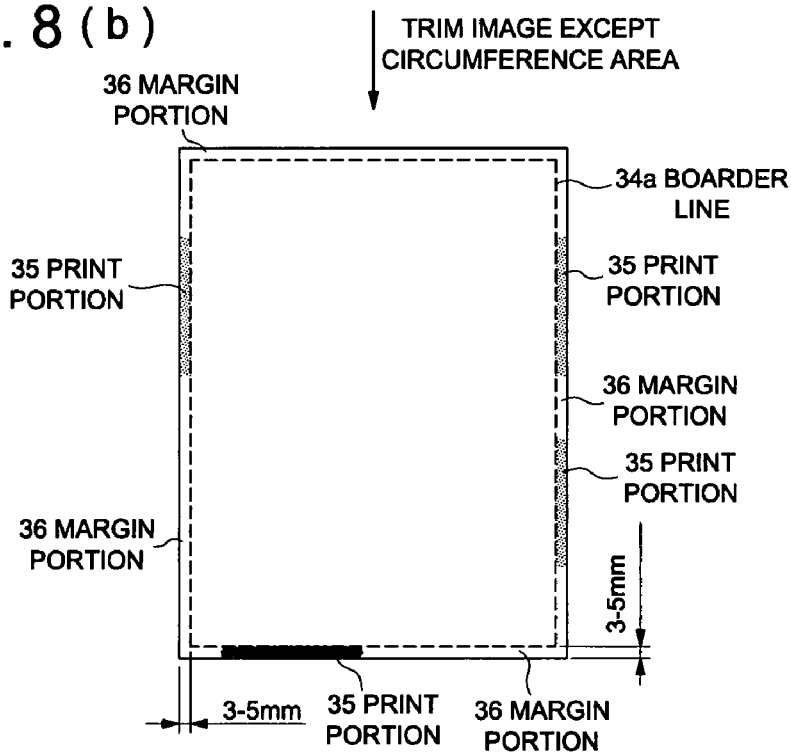
Figure 9:
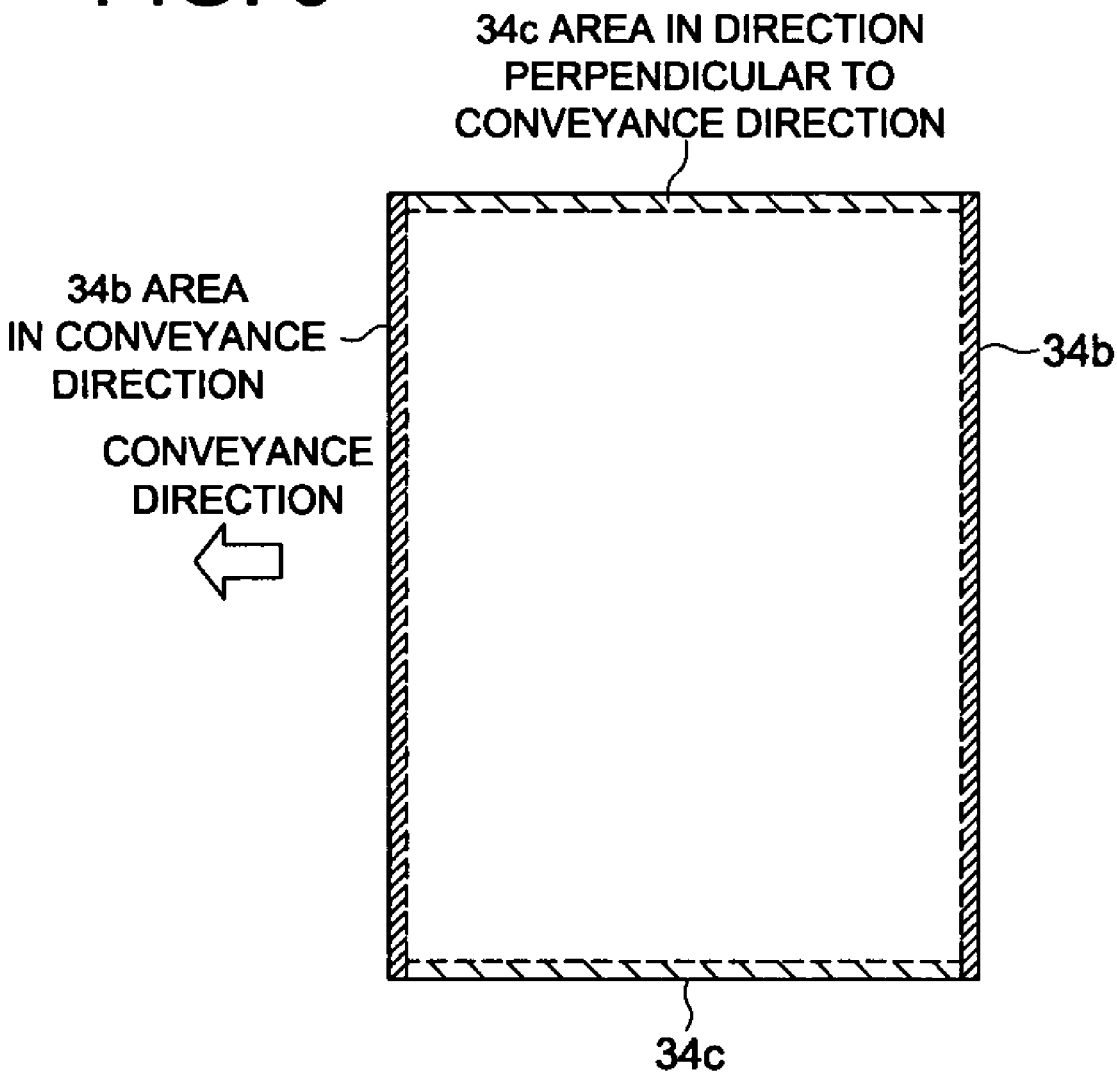
FIG. 9 illustrates another method in the comparison between the print ratio and a predetermined value of the embodiment of the present invention.
Figure 10:
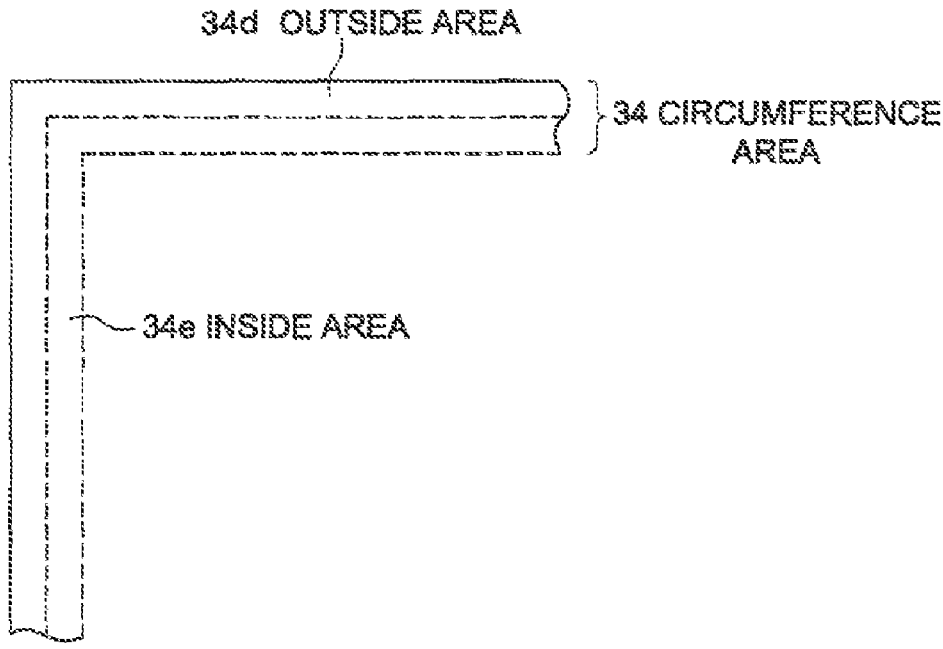
FIG. 10 illustrates another method in the comparison between the print ratio and a predetermined value of the embodiment of the present invention.
Figure 11:
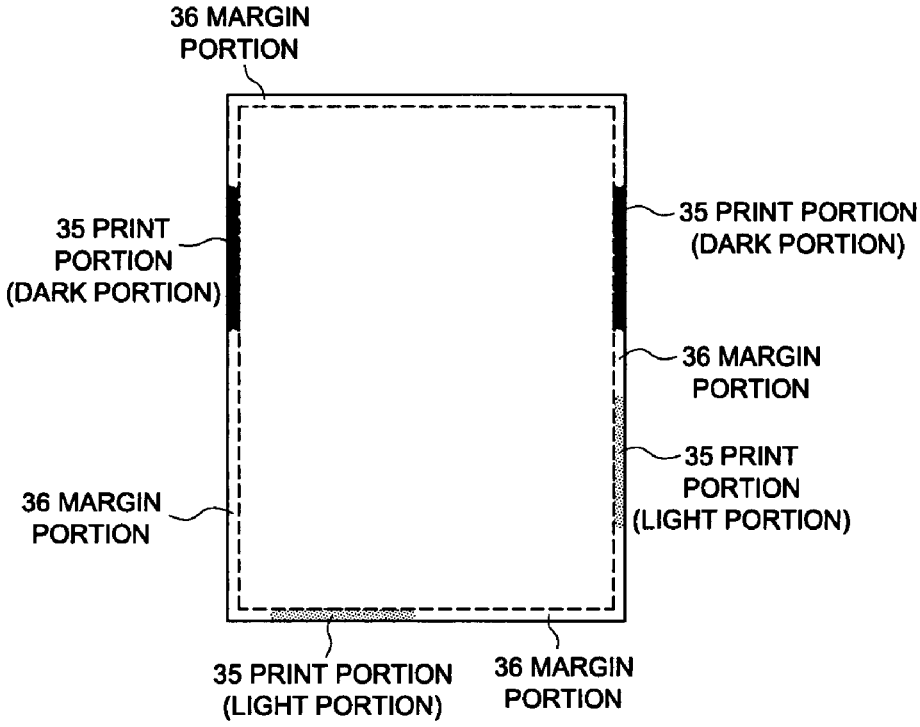
FIG. 11 illustrates the other example of the print ratio calculation method in the image forming apparatus of an embodiment of the present invention.

In order to describe an embodiment of the present invention in detail, an image forming apparatus, a control method and a control program thereof related to an embodiment of the present invention will be described by referring to FIGS. 1-11. FIG. 1 illustrates a block diagram showing a configuration of the image forming apparatus of the embodiment. FIG. 2 illustrates a block diagram showing the configuration of the control section of the image forming apparatus. FIG. 3 illustrates a detailed structure of the print section of the image forming apparatus. FIG. 4 illustrates the operation of respective modes of the image forming apparatus of the embodiment. FIG. 5 illustrates the cleaning process of the second transfer roller in the image forming apparatus of the embodiment. FIG. 6 illustrates a voltage pattern to be applied to the second roller. FIG. 7 illustrates a flowchart showing a print procedure by using the image forming apparatus of the embodiment. FIG. 8 illustrates the calculation method of a print ratio. FIGS. 9-11 illustrate the variations of the calculation method of a print ratio.

An image forming apparatus 1 of an embodiment of the present invention is, for example, a color copier of an electro photographic system. The image forming apparatus 1 includes a control section 2, an operation/display section 3, a scanner section 4, an image process section 5, a print section 6, an image storing section 7 and an image transmission reception section. Respective sections are connected by bus.

The control section 2 is configured by a CPU (Central Processing Unit), a ROM (Read Only Memory) and a RAM (Random Access Memory). The CPU reads out various programs stored in the ROM by the operation of the operation/display section 3, expands them in the RAM and controls respective sections of the image forming apparatus based on the expanded programs. For example, the control section 2 sets the operation mode into a normal mode (a margin area of several mm is provided in the circumference area of the transfer sheet and an image (here, character information of characters and symbols, and image information of photographs and figures are called an image as a general name) is formed only inside the margin area or into a full surface image mode (an image is formed on the full surface of the transfer sheet without providing the margin area described above) based on the signal from the operation/display section 3 and the signals from outside the image forming apparatus, controls respective sections according to the operation mode, which has been set and executes various processes.

As shown in FIG. 2, the control section 2 functions as an image determination section 2*a* for analyzing print data, and determining an existence area of an image (namely, an image to be actually formed or to have been formed as a toner image to be printed, which will be called a real image hereinafter) in a print image based on the print data, a transfer sheet size determination section 2*b* for determining the size of the transfer sheet, to which the print image is printed and a cleaning control section 2*c* for calculating the ratio of the real image in the circumference area of the transfer sheet (it will be called a print ratio) based on the determination results of the image determination section 2*a* and the transfer sheet size determination section 2*b* and determines whether the cleaning device is activated according to the comparison result of the print ratio and a predetermined value.

The device described above may be configured as hardware or may be configured as a control program allowing a computer to operate as the device described above and to run the control program on the control section 2. The image determination section 2*a* may determine the existence area of the real image based on the print data. Or the existence area of the real image may be determined by detecting the real image formed on the transfer sheet or the intermediated transfer belt by the optical method, which will be described later. In this case, the image determination section 2*a* is provided in a print section 6. The transfer sheet size determination section 2*b* may determine the size of the transfer sheet based on the signals inputted from the operation/display section 3 and the signals received through the image transmission reception section 8 or determine the size of the transfer sheet on the conveyance path of the transfer sheet by the optical method. In this case, the transfer sheet size determination section 2*b* is provided in the printer section 6.

The operation/display section 3 is a section provided on a display device, such as LCD (Liquid Crystal Display), having an operation device (a touch panel) of a pressure sensitive system, which is a transparent electrode disposed in a lattice pattern. The operation/display section 3 is arranged to display various operation buttons, the status displays of apparatuses and operation statuses of respective functions according to the display signals from the control section 2. The operation/display section 3 detects the voltage value of XY coordinates of a forced point pressed down by a fingerer or a touch pen and outputs the detected positional signals to the control section 2. Here, a display device and an operation device are uniformly configured into the operation/display section 3. However, an operation device disposing various operation buttons may be separately provided in addition to the display device.

The scanner section 4 is disposed under the glass, onto which an original document is placed to read the information recorded on the original document. The scanner section is configured by a CCD (Charge Coupled Devices) for converting lights reflected by the original document into electric-signals and an A/D converter for converting analog signals to digital signals.

The image processing section 5 applies various image processings, such as expansion/reduction, rotation, frequency conversion, color conversion from RGB data to YMCK data and density correction to the data read from the scanner section 4 and outputs them to the print section 6 as the print data.

The print section 6 includes an image forming section for forming the image to be printed onto the transfer sheet, a transfer section for transferring the formed image onto the transfer sheet, a conveyance section for conveying the transfer sheet and a cleaning device for cleaning the image forming section, the transfer section and the fixing section. As described later, the print section 6 forms an image based the electro-photography system onto the transfer sheet based on the print data of YMCK inputted from the image processing section 5.

An image storing section 7 is configured by a flash memory and a hard disk for storing the predetermined value, to which the cleaning control section 2 refers, and data of various setting conditions.

The image transmission reception section 8 is configured by a NIC (Network Interface Card), a modem, a LAN adapter, a router and a TA (a Terminal Adapter). The image transmission reception section 8 conducts a communication control between various apparatuses connected to the network and conducts the transmission and reception of the print data.

FIG. 1 illustrates a basic configuration of the image forming apparatus 1 of the embodiment. The other additional elements, such as an Automatic Document Feeder (ADF) and a finisher may be added.

Next, the detailed structure and the operation of the print section 6 will be described by referring to FIG. 3. The print section 6 includes a writing unit for irradiating laser beams based on the print data inputted from the image processing section 5 for conducting exposure (now shown), a photosensitive unit 11 for forming respective color toner images of Yellow (Y), Magenta (M), Cyan (C) and Black (K), the photosensitive unit 11 including a photosensitive drum 12, a developing device 13, a charger 14, a photosensitive cleaning section 15, and a first transfer roller 16, an intermediate transfer belt 17 functioning as an intermediate transfer body for conveying the toner images formed in the respective colors, a belt cleaning section 18 for cleaning the intermediate transfer belt 17, a second transfer roller 19 for transferring the toner image formed on the intermediate transfer belt 17, a roller cleaning section 20 for inputting voltage to conduct the transfer of the toner image and the cleaning operation, a fixing device 21 for fixing the toner image transferred onto the transfer sheet, a fixing device clearing section 22 for cleaning the fixing device 21, a sheet feeding roller for conveying the transfer sheet and a registration rollers 23, a loop roller 24, a reverse rollers 25 and 26, and a conveyance section, such as eject rollers.

In the print section 6 of the configuration described above, the photosensitive drum 12 rotates and the charger 14 charges the surface of the photosensitive drum 12. The laser beams from a writing unit (not shown) forms a Yellow image of a latent image based on the print data inputted from the image processing section 5. Then, the developer 13 forms the Yellow toner image on the latent image section. The toner image is transferred onto the intermediate transfer belt 17 by the pressure of the first transfer roller 16.

Similarly, on the photosensitive unit 11 of Magenta, Cyan and Black, a magenta toner image, a cyan toner image and black toner image are sequentially formed, sequentially transferred and superimposed onto the intermediate transfer belt 17 by the rotation of rollers. The toner, which has not been transferred, is removed by a photosensitive cleaning section 15 of respective photosensitive drums.

Then, the toner image, onto which YMDK on the intermediate transfer belt 17 has been superimposed, is transferred on the transfer sheet (second transfer) by passing the transfer sheet through a press section of a second transfer roller 19. The transfer sheet, onto which the toner image has been transferred, passes through a fixing device 21. The pressuring and heating of the fixing device 21 fix the YMCK toner image onto the transfer sheet and a color image is formed. The transfer sheet, onto which an image has been formed, is conveyed by ejection rollers to an ejection tray (not shown). When performing dual sided print, the transfer sheet, one side of which an image has been formed, is conveyed into a dual surface conveyance unit by the conveyance path switching board (not shown). The side of transfer sheet is reversed by the reverse rollers 25 and 26 of the dual surface conveyance unit. Then, the transfer sheet is conveyed to a second transfer roller 19 by the rotation of the registration rollers 23.

After the image formation to the transfer sheet, a belt cleaning section 18 removes the toner adhered onto the intermediate transfer belt 17. Further, a voltage from a roller cleaning section 20 is inputted to the second transfer roller 19. The toner adhered onto the second roller 19 is moved to the intermediate transfer belt 17 and the cleaning of the second roller 19 is conducted. Further, the fixing device cleaning section 22 removes the toner adhered onto the fixing device 21.

Here, as described above, when forming an image onto the transfer sheet by the image forming apparatus, there are two print modes. One is called a normal mode for printing an image in the image area having a margin area left in the circumference of the transfer sheet, and the other is called a full surface image mode for printing the image onto the full surface of the transfer sheet. In the full surface image mode, when transferring the Y, M, C and K toner images on the intermediate transfer belt 17 onto the transfer sheet, since there is a possibility that toner might dirty the image forming section, the transfer section and the fixing section, every time when an image is formed onto a transfer sheet, the cleaning device conducted the cleaning processes of respective sections.

However, even when the print is conducted in the full surface image mode, it is not always the case that full surface image is printed onto the all transfer sheet. As shown in FIG. 12(*b*), there is a case that a full surface image is formed only a part of a plurality of transfer sheets. If executing a cleaning process against the transfer sheet, onto which the full surface image is not formed (a transfer sheet 31 shown in the center of the figure), the interval to the next transfer sheet (a transfer sheet 31 shown in the right of the figure) has to be expanded and there is a problem that the output productivity is lowered.

Thus, in this invention, an image determination section 2*a*, a transfer sheet size determination section 2*b* and a cleaning control section 2*c* are provided in the image forming section 1. When conducting a print operation in the full surface image mode, the image determination section 2*a* determines the existence area of a real image to be actually printed or to have been printed in a print image against respective transfer sheets. And at the same time, the transfer sheet size determination section 2*b* determines the size of the transfer sheet. The cleaning control section 2*c* calculates the ratio (a print ratio) of the area of the real image to be formed in the circumference area against the area of the territory (the circumference area), which is inside the predetermined area from the edge of the transfer sheet and compares the print ratio with a predetermined value set in advance. When the print ratio is equal to and more than the predetermined value, the cleaning control section 2*c* determines that the probability of toner dirt occurrence is high. Then the cleaning control section 2*c* expands the interval to the next transfer sheets and activates the cleaning device. When the print ratio is less than the predetermined value, the cleaning control section 2*c* determines that the probability of toner dirt occurrence is low. Then the cleaning control section 2*c* narrows the interval to the next transfer sheets without activating the cleaning device.

Concretely describing, as shown in FIG. 4(*a*), in the case of a normal mode where a margin area 33 is left in the circumference of the transfer sheet 31 and an image is printed only in the image area 32, the interval between the transfer sheets 31 is set in the minimum width defined by the image forming apparatus 1, the same as the conventional way. However, as shown in FIG. 4(*b*), in the case of a full surface image mode where an image is printed in the full surface of the transfer sheet 31, for the transfer sheet having the print ratio of the circumference area 34 (the area outside the broken line), which is equal to and more than the predetermined value (for example, the transfer sheet in the left hand side in FIG. 4(*b*)), the interval to the next transfer sheet is expanded and the cleaning process is activated by operating the cleaning device in the interval. For the transfer sheet having the print ratio of the circumference area 34, which is less than the predetermined value (for example, the transfer sheet 31 in the center of FIG. 4(*b*)), no cleaning process is conducted and the interval to the next transfer sheet is set in the minimum width to improve the output productivity.

The distance from the edge of the transfer sheet 31, which sets the extent of the circumference area 34, can be appropriately set by taking account of the dispersion of the size of the transfer sheet 31 itself and the position shift when conveyed. However, the distance from the edge of the transfer sheet 31 is preferably set 3-5 mm. The predetermined value, which becomes a reference of the determination whether the cleaning process is conducted, can be arbitrarily set. However, it is preferable that whether toner dirt actually occurs is checked and the predetermined value should be set based on the result of this check. For example, a blacking ratio (the area ratio of the real image in the circumference area 34) can be set at a degree of 1%.

When setting the circumference area 34, the same distance from the edge against the conveyance direction of the transfer sheet and the direction, which is perpendicular to the conveyance direction can be set. However, with respect to the conveyance direction of the transfer sheet 31, since the transfer sheet 31 itself conducts the cleaning, and even if the image is formed in the edge section in the conveyance direction, no big problem occurs. Thus, with respect to the distance from the edge in the conveyance direction can be shortened. It may be possible to set different distances from the edge for respective directions. For the both sides of respective directions, the distances from the edge may be set at the same value or may be set at the different values in response to the character of the image forming apparatus 1 (for example, the transfer sheet tends to be shifted in the right side). Further, the circumference area 34 is set based on the distance from the edge of the transfer sheet 34 or based on the ratio against the external size of the transfer sheet 31 (for example, 95% of the external size).

Further, the cleaning device to be an object of the control is a device, which needs to stop or delay the image formation of the next transfer sheet when executing the cleaning process.

In a normal situation, the roller cleaning section 20 for cleaning the second roller 19 is an object of the control. However, a photosensitive drum cleaning section 15 for cleaning the photosensitive drum 12, a belt cleaning section 18 for cleaning the intermediate belt 17 and a fixing device cleaning section 22 for cleaning the fixing device 20 may be controlled the same as the roller cleaning section 20. With respect to the photosensitive drum cleaning section 15, the belt cleaning section 18 and the fixing device cleaning section 22, other than the control of whether cleaning operations of the photosensitive drum 12, of the belt cleaning section 18 and of fixing device 21 should be conducted, the cleaning condition change or further addition of a cleaning mechanism can be objects of the control when those are normally cleaned. Here, the cleaning condition change means the changes of a cleaning time, the change of the pressing strength of a cleaning member or the change of bias voltage. The addition of a cleaning mechanism means the addition of the bias voltage and the increase of the number of the cleaning member. In this invention, it is preferable that the cleaning of the photosensitive drum 12, the intermediate transfer belt 17 and or the fixing device 21 is normally conducted, and the cleaning process is executed and controlled by changing the cleaning conditions of those and the addition of the cleaning mechanism.

Further, this embodiment is characterized that even though when conducting a print operation in a full surface image mode, in case that the predetermined condition is satisfied, the cleaning process is not conducted. A known method of a cleaning process can be utilized. However, by conducting the cleaning process of the second transfer roller 16 by applying the point, which will be described below, toner dirt can be securely removed.

As shown in FIG. 5(*a*), under the condition that the transfer sheet 31 is inserted between the intermediate transfer belt 17, onto which toner transferred from the photosensitive drum 12 is adhered, and the second transfer roller 19, when the roller cleaning section 20 inputs a plus voltage to the second transfer roller 19, the toner adhered on the intermediate transfer belt 17, which has been charged into minus voltage, is absorbed to the transfer sheet 31 and transferred.

Here, when conducting a print operation in a normal mode, since toner is adhered only a position of the intermediate transfer belt 17 corresponding to the image area of the transfer sheet 31, the toner does not move to the second transfer roller 19 from the intermediate transfer belt 17 after the transfer sheet 31 passes through the second transfer roller 19. However, when conducting a print operation in a full surface image mode, as shown in FIG. 5(*b*), since toner is adhered on the position of the intermediate transfer belt 17 corresponding to even outside the transfer sheet 31, toner is moved to the second roller from the intermediate transfer belt 17 after the transfer sheet 31 passes through the second transfer roller 19.

Therefore, as shown in FIG. 5(*c*), the second transfer roller 19, onto which toner charged in minus voltage is adhered, rotates and when the toner approaches to the intermediate transfer belt 17, a roller cleaning section 20 inputs the minus voltage to the second roller as shown in FIG. 5(*d*), the electric field moves the toner adhered on the second roller 19 to the intermediate transfer belt 17. Thus the second transfer roller 19 can be cleaned up.

The explanation described above is a case where only the toner charged in minus is adhered on the second transfer roller. However, in reality, there is a case where a part of toner is charged in plus voltage. In this case, toner cannot be removed by inputting minus voltage to the second transfer roller 19. Therefore, as shown in FIG. 6, plus voltage and minus voltage having a predetermined interval are alternatively inputted to the second roller 19 after minus voltage is inputted to the second transfer roller 19 in the procedure described above to conduct the cleaning operation.

Next, a procedure for forming an image onto a plurality of transfer sheets in a full surface image mode by using the image forming apparatus 1 having the configuration described above will be described by referring to the flowchart in FIG. 7. In the flowchart below, the image determination section 2*a* determines an existence area of a real image based on print data and the transfer sheet size determination section 2*b* determines the size of the transfer sheet based on inputted information.

Firstly, in step S101, a user operates the operation/display section 3 to input image forming conditions, and confirms the transfer sheet size. Then, the transfer sheet size determination section 2*b* determines the transfer sheet size based on the inputted information. After that, the scanner section 4 reads the original document and the image process section 5 conducts the predetermined process to form print data. The image transmission reception section 8 receives the print data.

Next, in step S102, the control section 2 determines whether N-th page print data has been inputted. When the print data has been inputted, in the step S103, the image determination section 2*a* analyzes the print data (for example, analyzes the deployed position and the value of respective elements, which have been deployed) and fixes the existence area of the real image to be actually printed in the print image based on the print data and a magnification factor. After that, the control section 2 stores the print data into the image storage section 7.

Next, in step S104, the cleaning control section 2*c* trims the center portion of the real image formed in the image area 32 as shown in FIG. 8 in the other area of the image memory based on the determination results of the image determination section 2*a* and the transfer sheet size determination section 2*b*, specifies the real image existing in the circumference area of the transfer sheet (for example, the area outside the boarder line 34*a* located at 3-5 mm from the edge) and calculates the ratio (print ratio) of the area of a print portion 35 against the area of the circumference area of the transfer sheet (the area obtained by summing up the print portion 35 where an image exists and the margin portion 36 where the real image does not exist) in step S105.

In step S106, which is parallel with the processes of steps 104 and 105 described above, the control section 2 transmits the print data to the print section 6. The print section 6 forms a toner image onto the photosensitive drum 12 based on the print data, and conducts the first transfer of the toner image to the intermediate transfer belt 17. The second transfer roller 19 conducts the second transfer of the toner image to the transfer sheet.

Next, in step S107, the cleaning control section 2*c* compares the calculated print ratio with a predetermined value set in advance. When the print ratio is equal to or more than the predetermined value, in step S108, a real image is formed in the circumference area of the transfer sheet and determines that the possibility of the toner dirt occurrence is high. Then the interval (namely, an image formation interval) to the next transfer sheet (N+1 page) is set at the distance, which is equal to or more than the predetermined value and at which a cleaning operation can be executed. Then at step S109, the cleaning process described above is executed. On the other hand, when the print ratio is less than the predetermined value, in step S110, it is determined that a real image is not formed in the circumference area of the transfer sheet and the possibility of the toner dirt occurrence is low. Then the interval (namely, an image formation interval) to the next transfer sheet (N+1 page) is set at the minimum distance to promote the print process.

When comparing the print ratio with the predetermined value, as described above, since the transfer sheet itself removes toner dirt in the conveyance direction of the transfer sheet, as shown in FIG. 9, it is possible to divide the circumference area into a plurality of areas, such as the area 34*b* of the transfer sheet conveyance direction and the area 34*c* of the direction perpendicular to the conveyance direction, and compare respective print ratios of respective areas with different predetermined values, for example, compare with a large predetermined value for the area 34*a*. Since it is feasible that the degree of dirt by the toner is different in the case where the image in the circumference area is centralized to the edge section side and in the case where the image in the circumference area is centralized to the center section in the circumference area, as shown in FIG. 10, the circumference area may be divided into a plurality of areas, such as, an outside area 34*d* and inside area 34*e* to compare respective print ratios with different predetermined values for respective areas, for example, compare the print ratio in the outside area 34*d* with a small predetermined value. Further, since it is feasible that the degree of the toner dirt is different by the color or density of the image to be formed in the circumference area, as shown in FIG. 11, the print ratio may be derived by multiplying the coefficient (for example, when the color is black or the density is dense, the value is large) set against the color and density to the area of respective print portions 35.

After that, in step 111, the control section 2 determines whether the process of all pages has finished. When the process of all pages has not finished yet, in step S112, the process for feeding a transfer sheet of a next page is conducted and the process returns to step S102 to conduct the same processes.

As described above, in this embodiment, the image determination section 2*a*, the transfer sheet size determination section 2*b* and the cleaning control section 2*c* are provided in the image forming apparatus 1. The cleaning section 2*c* calculates the print ratio of the real image in the circumference of the transfer sheet, expands the interval to the next transfer sheet when the print ratio is not less than the predetermined value and executes the cleaning process. When the print ratio is less than the predetermined value, the interval to the next transfer sheet is set in the minimum value. Thus, when the transfer sheet, onto which a real image is formed on a full surface and the transfer sheet, in the circumference of which no real image is formed, are mixed, since useless cleaning process can be omitted, the lowering of the output productivity can be suppressed.

According to the image forming apparatus and the control method thereof of an embodiment of the present invention, lowering of the output productivity in the mode where an image is printed on the full surface of the transfer sheet can be suppressed.

The reason why the output productivity can be improved is as following.

An image determination section for determining the existence area of an image (a real image) in a print image, which will be printed or has been printed based on print data, a transfer sheet size determination section for determining the size of the transfer sheet, onto which the print image is printed, and a cleaning control section for calculating the print ratio of the real image against a circumference area of the transfer sheet based on the determination results of the image determination section and the transfer sheet size determination section, and controlling the cleaning device according to the print ratio, are provided in an image forming apparatus having a cleaning device at least in any one of the image forming section, the transfer section and the fixing section.

In the image forming apparatus, since the cleaning control section is arranged to compare the calculated print ratio with a predetermined value set in advance for each transfer sheet, and to determine whether the interval to the next transfer sheet is expanded or the interval to the next transfer sheet is narrowed without activating the cleaning device, even though when the mode, where an image is printed onto the full surface of the transfer sheet, has been set, when the existence ratio of the real image in the circumference area of the transfer sheet is low, the cleaning device can shorten the interval to the next transfer sheet without activation of the cleaning device.

In this embodiment, the image forming apparatus including a normal mode and a full surface image mode has been described. However, the present invention is not limited to the embodiment described above. The present invention can be applied to the image forming apparatus, which is, at least, capable of conducting a print operation in a full surface image mode. In this embodiment described above, the present invention has been applied to a color print operation. However, the present invention may be applied to a black and white print operation as well.

What is claimed is:

1. An image forming apparatus comprising:

an image forming section to form a toner image based on print data;

a transfer section to transfer the toner image onto a transfer sheet;

a fixing section to fix the toner image transferred onto the transfer sheet;

a cleaning section to clean at least one of the image forming section, the transfer section and the fixing section; and a control section comprising: (i) an image determination section to determine an existence area of a real image in a print image based on the print data, (ii) a transfer sheet size determination section to determine a size of the transfer sheet onto which the print image is printable; and (iii) a cleaning control section to control the cleaning device based on determinations of the image determination section and the transfer sheet size determination section;

wherein the cleaning control section is configured to: (i) calculate a print ratio of an area of the real image to be formed in a circumference area of the transfer sheet against the circumference area, the circumference area being a predetermined area from an edge of the transfer sheet, (ii) compare the print ratio with a predetermined value set in advance, (ii) activate the cleaning section when the print ratio is at least equal to the predetermined value, (iii) not activate the cleaning section when the print ratio is less than the predetermined value, (iv) set an interval between the transfer sheet and a next transfer sheet to a first interval when the print ratio is at least equal to the predetermined value, and (v) set the interval between the transfer sheet and the next transfer sheet to a second interval which is shorter than the first interval when the print ratio is less than the predetermined value.

2. The image forming apparatus of claim 1, wherein the cleaning section includes a cleaning section to clean a second transfer roller that transfers a toner image transferred on an intermediate transfer belt.

3. An image forming apparatus capable of selecting at least a mode in which an image is printable onto a full surface of a transfer sheet, the image forming apparatus comprising:

an image forming section to form a toner image based on print data;

a transfer section to transfer the toner image onto the transfer sheet;

a fixing section to fix the toner image transferred onto the transfer sheet;

a cleaning section to clean at least one of the image forming section, the transfer section and the fixing section; and a control section comprising: (i) an image determination section to determine an existence area of a real image in a print image based on the print data, (ii) a transfer sheet size determination section to determine a size of the transfer sheet onto which the print image is printable, and (iii) a cleaning control section for, when printing a plurality of transfer sheets in the full surface printing mode, determining whether the cleaning device is activated for the respective transfer sheets, wherein the determination regarding activating the cleaning device for the respective transfer sheets is performed according to a print ratio of the real image existing in a circumference area of the respective transfer sheets;

wherein the cleaning control section is configured to: (i) calculate the print ratio of an area of the real image to be formed in the circumference area of the transfer sheet against the circumference area, the circumference area being a predetermined area from an edge of the transfer sheet, (ii) compare the print ratio with a predetermined value set in advance, (iii) activate the cleaning section when the print ratio is at least equal to the predetermined value, (iv) not activate the cleaning section when the print ratio is less than the predetermined value, (v) set an interval between the transfer sheet and a next transfer sheet to a first interval when the print ratio is at least equal to the predetermined value, and (vi) set the interval between the transfer sheet and the next transfer sheet to a second interval which is shorter than the first interval when the print ratio is less than the predetermined value.

4. The image forming apparatus of claim 3, wherein the cleaning section includes a cleaning section to clean a second transfer roller that transfers a toner image transferred on an intermediate transfer belt.

5. A control method for controlling an image forming apparatus comprising: (i) an image forming section to form a toner image based on print data; (ii) a transfer section to transfer the toner image onto a transfer sheet; (iii) a fixing section to fix the toner image transferred onto the transfer sheet; and (iv) a cleaning section to clean at least one of the image forming section, the transfer section and the fixing section, the method comprising:

determining an existence area of a real image in a print image based on the print data;

determining a size of the transfer sheet onto which the print image is printable; and determining whether or not to activate the cleaning section based on the determined existence area of the real image and the determined size of the transfer sheet;

wherein a print ratio of an area of the real image to be formed in a circumference area of the transfer sheet against the circumference area is calculated, the circumference area being a predetermined area from an edge of the transfer sheet, the print ratio is compared with a predetermined value set in advance, and the cleaning section is activated when the print ratio is at least equal to the predetermined value, and the cleaning section is not activated when the print ratio is less than the predetermined value; and wherein an interval between the transfer sheet and a next transfer sheet is set to a first interval when the print ratio is at least equal to the predetermined value, and the interval between the transfer sheet and the next transfer sheet is set to a second interval which is shorter than the first interval when the print ratio is less than the predetermined value.

6. The control method of claim 5, wherein the cleaning section includes a cleaning section for cleaning a second transfer roller that transfers a toner image transferred on an intermediate transfer belt.

* * * * *